US006648157B2

(12) United States Patent
Shai et al.

(10) Patent No.: US 6,648,157 B2
(45) Date of Patent: Nov. 18, 2003

(54) REINFORCED PLASTIC NECK FINISH

(75) Inventors: Amit Shai, Gan Ner North (IL); Yair Barkai, Kibbutz Ashdot Ya'acov Ichud (IL)

(73) Assignee: Log-Plastic Products Company (1993) Ltd., Ya'acov Ichud (IL)

( * ) Notice: Subject to any disclaimer, the term of this patent is extended or adjusted under 35 U.S.C. 154(b) by 0 days.

(21) Appl. No.: 10/120,719

(22) Filed: Apr. 11, 2002

(65) Prior Publication Data

US 2003/0192852 A1 Oct. 16, 2003

(51) Int. Cl.[7] ..... B65D 1/46
(52) U.S. Cl. ..... 215/42; 215/43; 215/357
(58) Field of Search ..... 215/42, 40, 43, 215/218, 357

(56) References Cited

U.S. PATENT DOCUMENTS 491,198 A * 2/1893 Straus ..... 215/40
3,405,831 A * 10/1968 Hudson ..... 215/44
4,298,129 A * 11/1981 Stull ..... 215/318 X
4,649,068 A * 3/1987 Collette ..... 215/42
5,005,716 A 4/1991 Eberle
5,103,991 A * 4/1992 Collins ..... 215/329
5,307,946 A * 5/1994 Molinaro ..... 215/329
5,366,774 A * 11/1994 Pinto et al. ..... 215/42
6,016,932 A 1/2000 Gaydosh et al.
6,044,996 A 4/2000 Carew et al.
6,142,326 A * 11/2000 Cornell et al. ..... 215/40 X
6,227,391 B1 * 5/2001 King ..... 215/307
6,347,717 B1 2/2002 Eberle

* cited by examiner

*Primary Examiner*—Tri M. Mai
(74) *Attorney, Agent, or Firm*—Ladas & Parry

(57) ABSTRACT

A plastic hot fill container including a container body, which is integrally formed as one piece with a flange, the flange having a generally cylindrical outer facing wall surface onto which are formed a plurality of typically mutually spaced threading protrusions, the flange being characterized in that it is formed with at least one thickened flange portion located at the region of at least one leading edge of the threading protrusions.

7 Claims, 1 Drawing Sheet

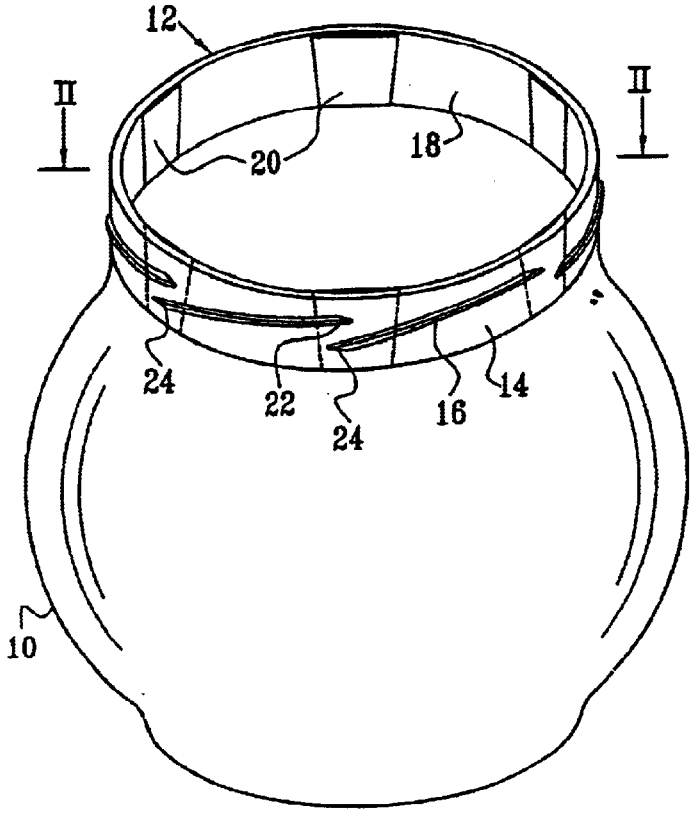
FIG. 1
FIG. 2
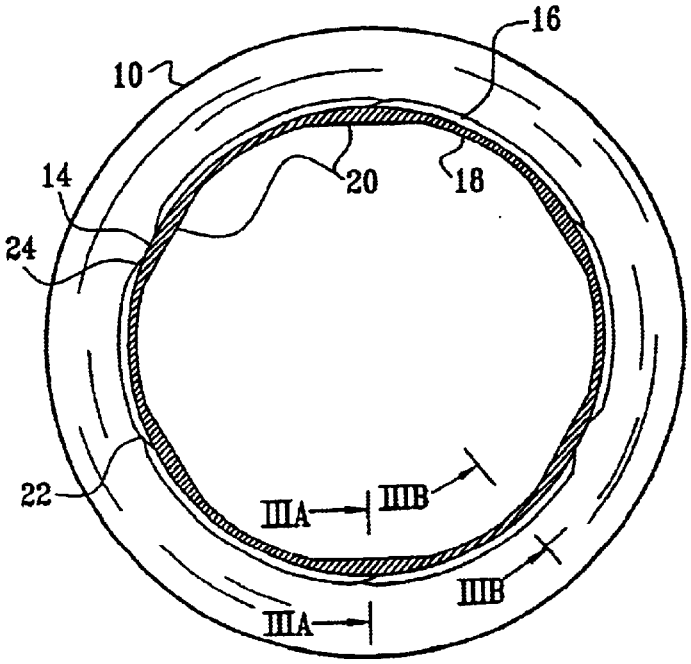
FIG. 3A
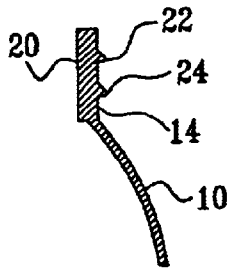
FIG. 3B
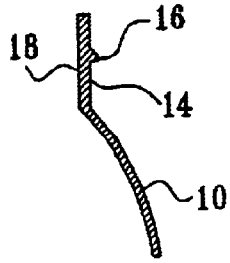

REINFORCED PLASTIC NECK FINISH

FIELD OF THE INVENTION

The present invention relates to containers and more particularly to threaded containers formed of plastic.

BACKGROUND OF THE INVENTION

The following patents are believed to represent the current state of the art

U.S. Pat. Nos. 6,347,717; 6,044,996; 6,016,932 and 5,005,716.

SUMMARY OF THE INVENTION

The present invention seeks to provide an improved plastic threaded container.

There is thus provided in accordance with a preferred embodiment of the present invention a plastic hot fill container including a container body, which is integrally formed as one piece with a flange, the flange having a generally cylindrical outer facing wall surface onto which are formed a plurality of typically mutually spaced threading protrusions, the flange being characterized in that it is formed with at least one thickened flange portion located at the region of at least one leading edge of the threading protrusions.

Preferably, the at least one leading edge of the threading protrusions partially overlaps a trailing edge of at least one adjacent threading protrusion.

In accordance with a preferred embodiment of the present invention, the at least one thickened flange portion is formed on an inner facing wall of the flange.

Preferably, the plastic hot fill container is formed by blow molding polyester. Preferably, the flange is formed by injection molding polyester.

In accordance with a preferred embodiment of the present invention an inner facing wall surface is straight at the at least one thickened flange portion. Alternatively, the inner facing wall surface is slightly convex at the at least one thickened flange portion.

BRIEF DESCRIPTION OF THE DRAWINGS

The present invention will be understood and appreciated more fully from the following detailed description, taken in conjunction with the drawings in which:

FIG. 1 is a pictorial illustration of a container constructed and operative in accordance with a preferred embodiment of the present invention;

FIG. 2 is a sectional illustration taken along the lines II—II of FIG. 1; and FIGS. 3A & 3B are sectional illustrations taken along the lines IIIA—IIIA and IIIB—IIIB of FIG. 2.

DETAILED DESCRIPTION OF A PREFERRED EMBODIMENT

Reference is now made to FIGS. 1–3B, which illustrate a hot-fill, twist-off plastic container constructed and operative in accordance with a preferred embodiment of the present invention. The container is preferably formed by blow molding polyester, although any other suitable technique or material may alternatively be employed.

As seen in FIGS. 1–3B, the container comprises a container body 10, which is integrally formed as one piece with a flange 12, which is also referred to as a finish or neck finish. Flange 12 has a generally cylindrical outer facing wall surface 14 onto which are formed a plurality of typically mutually spaced threading protrusions 16. The flange is preferably formed by injection molding polyester, although any other suitable technique or material may alternatively be employed.

It is appreciated that container body 10 may be of any suitable shape and size and that the threading protrusions 16 may also be of any suitable shape, size and arrangement.

In accordance with a preferred embodiment of the present invention, the flange has a generally cylindrical inner facing wall surface 18 which is non-circular. Preferably, the wall surface 18 is configured so as to define a plurality of thickened flange portions 20 which are located at the region of the leading edges 22 of the threading protrusions 16, which are initially engaged by a lid, such as a twist-off lid, during sealing attachment of the lid during a hot-filling process. Preferably the extent of thickened flange portions 20 is such that they extend over the trailing edges 24 of adjacent threading protrusions 16, which typically partially overlap the leading edges 22.

In the illustrated embodiment the inner facing wall surface 18 is straight or slightly convex at thickened flange portions 20.

It is a particular feature of the present invention that the provision of thickened flange portions 20 enables the container and more particularly the flange 12 and protrusions 16 to maintain their integrity, notwithstanding weakening of the container material during hot fill operations and the mechanical stresses applied during twisting on threaded engagement of the cap thereto.

It will be appreciated by persons skilled in the art that the present invention is not limited by what has been particularly shown and described hereinabove. Rather the scope of the present invention includes both combinations and subcombinations of various features described and shown herein and modifications and variations thereof which are not known in the prior art.

What is claimed is:

1. A plastic hot fill container comprising a container body, which is integrally formed as one piece with a flange, said flange having a generally cylindrical outer facing wall surface onto which are formed a plurality of mutually spaced threading protrusions having leading edges and trailing edges and a generally cylindrical inner facing wall surface which has a first thickness and, flange being characterized in that it is formed with at least one thickened flange portion having a second thickness, greater than said first thickness, located at the region of at least one leading edge of said threading protrusions, said at least one thickened flange portion extending over at least one leading edge of a threading protrusion and at least one trailing edge of a threading protrusion adjacent thereto.

2. A plastic hot fill container according to claim 1 wherein said at least one leading edge of said threading protrusions partially overlaps a trailing edge of at least one adjacent threading protrusion.

3. A plastic hot fill container according to claim 1 wherein said at least one thickened flange portion is formed in an inner facing wall of said flange.

4. A plastic hot fill container according to claim 1 wherein said plastic hot fill container is formed by blow molding plastic.

5. A plastic hot fill container according to claim 1 wherein said flange is formed by injection molding plastic.

6. A plastic hot fill container according to claim 1 wherein an inner facing wall surface is straight at said at least one thickened flange portion.

7. A plastic hot fill container according to claim 1 wherein an inner facing wall surface is slightly convex at said at least one thickened flange portion.

* * * * *